US010130223B2

(12) United States Patent
Sauer et al.

(10) Patent No.: US 10,130,223 B2
(45) Date of Patent: Nov. 20, 2018

(54) VACUUM CLEANING DEVICE WITH A TANK-TYPE VACUUM CLEANER

(71) Applicant: Eurofilters Holding N.V., Overpelt (BE)

(72) Inventors: Ralf Sauer, Overpelt (BE); Jan Schultink, Overpelt (BE)

(73) Assignee: Eurofilters Holding N.V., Overpelt (BE)

( * ) Notice: Subject to any disclaimer, the term of this patent is extended or adjusted under 35 U.S.C. 154(b) by 226 days.

(21) Appl. No.: 15/300,203

(22) PCT Filed: Mar. 12, 2015

(86) PCT No.: PCT/EP2015/055142

§ 371 (c)(1),
(2) Date: Sep. 28, 2016

(87) PCT Pub. No.: WO2015/150041

PCT Pub. Date: Oct. 8, 2015

(65) Prior Publication Data

US 2017/0181590 A1 Jun. 29, 2017

(30) Foreign Application Priority Data

Apr. 4, 2014 (EP) ..... 14163582

(51) Int. Cl.
*A47L 5/36* (2006.01)
*A47L 9/24* (2006.01)
(Continued)

(52) U.S. Cl.
CPC ..... *A47L 5/365* (2013.01); *A47L 9/122* (2013.01); *A47L 9/1427* (2013.01); *A47L 9/22* (2013.01); *A47L 9/242* (2013.01)

(58) Field of Classification Search
CPC ..... A47L 5/365; A47L 9/122; A47L 9/1427; A47L 9/22; A47L 9/242
See application file for complete search history.

(56) References Cited

U.S. PATENT DOCUMENTS 4,021,879 A * 5/1977 Brigham ..... A47L 9/2821 15/319
4,575,895 A * 3/1986 Spellman ..... A47L 9/1418 15/327.1

(Continued)

FOREIGN PATENT DOCUMENTS

BE EP 2641523 A1 * 9/2013 ..... A47L 9/14
CH 161 292 A 4/1933

(Continued)

OTHER PUBLICATIONS

"Verordnung (EU) Nr. 666/2013 Der Kommission vom 8, Jul. 2013 zur Durchführung der Richtlinie 2009/125/EG des Europäischen Parlaments und des Rates im Hinblick auf die Festlegung von Anforderungen an die umweltgerechte Gestaltung von Staubsaugern"; Amtsblatt der Europäischen Union, Jul. 13, 2013; pp. L192/24-L192/34; XP055123977; retrieved from the Internet at http://eur-lex.europa.eu/LexUriServ/LexUriServ.do?uri=OJ:L:2013:192:0024:0034:DE:PDF on Jun. 18, 2014.

(Continued)

*Primary Examiner* — Marc Carlson
(74) *Attorney, Agent, or Firm* — Brinks Gilson & Lione

(57) ABSTRACT

The invention relates to a vacuum cleaning device with a tank-type vacuum cleaner, a suction hose which is connected to the housing of the tank-type vacuum cleaner, and a filter bag. The tank-type vacuum cleaner has a motor fan unit which is designed such that the average electric input power of the fan unit ranges from 1000 W to 200 W and results in a vacuum of more than 12.5 kPa in the measuring chamber (Continued)

when using aperture 6 and a vacuum of more than 4.0 kPa in the measuring chamber when using aperture 8 in the event of an average electric power input ranging from 1000 W to 800 W; a vacuum of more than 10.0 kPa in the measuring chamber when using aperture 6 and a vacuum of more than 3.4 kPa in the measuring chamber when using aperture 8 in the event of an average electric power input ranging from 799 W to 600 W; a vacuum of more than 7.0 kPa in the measuring chamber when using aperture 6 and a vacuum of more than 2.5 kPa in the measuring chamber when using aperture 8 in the event of an average electric power input ranging from 599 W to 400 W; and a vacuum of more than 4.0 kPa in the measuring chamber when using aperture 6 and a vacuum of more than 1.4 kPa in the measuring chamber when using aperture 8 in the event of an average electric power input ranging from 399 W to 200 W. The suction hose has an average cross-sectional area of at least 9 $cm^2$, in particular at least 11 $cm^2$ or 13 $cm^2$, and the filter bag has a bag surface area between 2500 $cm^2$ and 5000 $cm^2$ and is a disposable filter bag made of a nonwoven fabric.

18 Claims, 10 Drawing Sheets

(51) Int. Cl.

| | |
|---|---|
| ***A47L 9/14*** | (2006.01) |
| ***A47L 9/22*** | (2006.01) |
| ***A47L 9/12*** | (2006.01) |

(56) References Cited

U.S. PATENT DOCUMENTS

| | | | | | |
|---|---|---|---|---|---|
| 4,591,369 | A | | 5/1986 | Stewart, Sr. et al. | |
| 4,699,641 | A | * | 10/1987 | Barnes, Jr. | A47L 9/1427 15/352 |
| 6,156,086 | A | * | 12/2000 | Zhang | A47L 9/14 428/36.1 |
| 9,402,520 | B2 | * | 8/2016 | Sauer | A47L 9/14 |
| 2006/0016043 | A1 | * | 1/2006 | Matsuhashi | A47L 9/122 15/353 |
| 2011/0162335 | A1 | * | 7/2011 | Frei | A47L 5/36 55/372 |
| 2015/0026918 | A1 | * | 1/2015 | Sauer | A47L 9/14 15/347 |
| 2015/0067980 | A1 | * | 3/2015 | Schultink | A47L 9/14 15/347 |
| 2016/0022105 | A1 | * | 1/2016 | Sauer | B01D 39/1623 55/485 |

FOREIGN PATENT DOCUMENTS

| | | | | | |
|---|---|---|---|---|---|
| DE | 30 41 167 | A1 | | 5/1982 | |
| DE | 85 06 818 | U1 | | 7/1986 | |
| DE | 199 42 483 | C1 | | 2/2001 | |
| DE | 20 2005 000 917 | U1 | | 4/2005 | |
| DE | 1 0 2008 006 769 | A1 | | 8/2009 | |
| DE | WO 2010018101 | A1 | * | 2/2010 | A47L 5/362 |
| EP | 2 186 462 | A2 | | 5/2010 | |
| EP | 2 236 072 | A2 | | 10/2010 | |
| EP | 2 366 320 | A1 | | 9/2011 | |
| EP | 2 366 321 | A1 | | 9/2011 | |
| EP | 2 374 394 | A1 | | 10/2011 | |
| EP | 2 374 395 | A1 | | 10/2011 | |
| EP | 2 641 523 | A1 | | 9/2013 | |
| JP | S56 132926 | A | | 10/1981 | |
| WO | WO 84/02282 | A1 | | 6/1984 | |
| WO | WO 2007/059936 | A1 | | 5/2007 | |
| WO | WO 2007/059937 | A1 | | 5/2007 | |
| WO | WO 2007/059938 | A1 | | 5/2007 | |
| WO | WO 2007/059939 | A1 | | 5/2007 | |
| WO | WO 2010/018101 | A1 | | 2/2010 | |
| WO | WO 2011/020699 | A1 | | 2/2011 | |
| WO | WO 2012/126612 | A1 | | 9/2012 | |
| WO | WO 2012/126613 | A1 | | 9/2012 | |

OTHER PUBLICATIONS

International Search Report for International Application No. PCT/EP2015/055142 dated May 22, 2015.

* cited by examiner

VACUUM CLEANING DEVICE WITH A TANK-TYPE VACUUM CLEANER

This application claims the benefit under 35 U.S.C. § 371 of International Application No. PCT/EP2015/055142, filed Mar. 12, 2015, which claims the benefit of European Patent Application No. 14163582.1, filed Apr. 4, 2014, which are incorporated by reference herein in their entirety.

FIELD OF THE INVENTION

The invention relates to a vacuum cleaning device with a tank-type vacuum cleaner, a suction hose which is connected to the housing of the tank-type vacuum cleaner, and a filter bag made of nonwoven material.

Definitions

The description of prior art and the invention are based on the following Standards, definitions and measurement methods.

VO 666/2013: COMMISSION REGULATION (EU) No 666/2013 of 8 Jul. 2013, implementing Directive 2009/125/EC of the European Parliament and of the Council with regard to ecodesign requirements for vacuum cleaners.

VO 665/2013: COMMISSION DELEGATED REGULATION (EU) No 665/2013 of May 3, 2013, supplementing Directive 2010/30/EU of the European Parliament and of the Council with regard to energy labelling of vacuum cleaners.

Nominal input power: The nominal input power in W means the electric input power declared by the manufacturer, wherein for appliances that are enabled to function also for other purposes than vacuum cleaning, only the electric input power relevant to vacuum cleaning applies (VO 666/2013, Annex II section 2, lit. k).

EN 60312: EN 60312 designates—unless explicitly otherwise stated—Standard DIN EN 60312-1 (VDE 0705-312-1) in the edition of January 2014: Vacuum cleaners for household use—Part 1: Dry vacuum cleaners—Methods for measuring the performance (IEC 60312-1: 2010, modified+A1:2011, modified); German version EN 60312-1:2013.

Determination of air data: The air data of a vacuum cleaner is determined according to EN 60312 section 5.8. Thereby, the measuring device B according to section 7.3.7.3 is used. Where motor/fan units are measured apart, i.e. without the vacuum cleaner housing, then measuring device B is also used. For necessary intermediate parts, where appropriate for connection to the measuring chamber, the explanations in section 7.3.7.1 apply.

Input power of a vacuum cleaner: The input power $P_1$ of a vacuum cleaner with a predetermined aperture (orifice) is determined according to EN 60312 section 5.8. Thereby, the measuring device B according to section 7.3.7.3 is used. For necessary intermediate parts, where appropriate for connection to the measuring chamber, the explanations in section 7.3.7.1 apply.

Input power of a motor/fan unit: The input power $P_1$ of a motor/fan unit with a predetermined aperture, as well, is determined according to EN 60312 section 5.8. Thereby, the measuring device B according to section 7.3.7.3 is used. For necessary intermediate parts, where appropriate for connection to the measuring chamber, the explanations in section 7.3.7.1 apply.

Average electrical rated input power of a vacuum cleaner: The average input power of a vacuum cleaner is conducted with the experimental setup for determination of air data according to EN 60312, section 5.8. The measuring chamber device B is used. For necessary intermediate parts, where appropriate for connection to the measuring chamber, the explanations in section 7.3.7.1 apply. The average rated input power is defined as $$P=0.5(P_f+P_i)$$

$P_f$=Input power in watts after 3 minutes operation on the measuring chamber at aperture 9 (rated diameter $d_0$=50 mm).

$P_i$=Input power in watts after further 20 sec operation on the measuring chamber at aperture 0 (rated diameter $d_0$=0 mm).

Average electrical rated input power of the motor/fan unit: The average electrical rated input power of a motor/fan unit is conducted with the experimental setup for determining the air data according to EN 60312 section 5.8. Therefore, the motor/fan unit is directly connected to the measuring chamber (device B). For necessary intermediate parts, where appropriate for connection to the measuring chamber, the explanations in section 7.3.7.1 apply. The average input power is defined as $$P_m=0.5(P_f+P_i)$$

$P_f$=Input power in watts after 3 minutes operation on the measuring chamber at aperture 9 (rated diameter $d_0$=50 mm).

$P_i$=Input power in watts after further 20 sec operation on the measuring chamber at aperture 0 (rated diameter $d_0$=0 mm).

Average input power during the determination of the functional characteristics with a filled dust container: The average input power when determining the functional characteristics with a filled dust container is determined in compliance with EN 60312 (cf. in particular section 5.9). Deviating from this Standard, the measuring is conducted with the measuring chamber B at aperture 8. The average input power during determination of the functional characteristics with a filled filter bag is defined as being the average value of the input power with an empty filter bag and the input power with a filled filter bag. For suctioning the test dust and the maximum suctioned quantity (filled filter bag), the conditions from section 5.9.2, in particular also the conditions from 5.9.2.3 apply.

Air flow: The air flow is determined according to EN 60312 with the measuring chamber device B. The air flow may be determined with different apertures. According to EN 60312, at an aperture, a diameter of 30 mm is measured. If, deviating therefrom, it is measured with another aperture, this is indicated. In the prior art, this air flow is often also referred to as volume flow or suction air flow.

Air flow drop: The air flow drop is determined in compliance with EN 60312 section 5.9 with the measuring chamber according to device B. Deviating from this Standard, the measuring chamber is equipped with a 40 mm perforated plate (30 mm according to the Standard). The vacuum values $h_f$ in the measuring chamber are converted according to section 7.3.7 into an air flow. The difference of the air flow with an empty filter bag and the air flow with a charged filter bag is designated as air flow drop.

Disposable filter bags: A disposable filter bag or disposable bag in the meaning of the present invention are understood as being throwaway filter bags.

Flat bags: A flat bag is understood as being filter bags whose filter bag wall is formed of two single layers of filter material having the same surface area such that the two individual layers are joined only at their peripheral edges to one another (the term same surface area of course does not exclude that the two individual layers differ from one another due to the fact that one of the layers has an entry opening).

The connection of the individual layers can be implemented by weld or adhesive seams along the entire circumference of the individual layers.

Alternatively, the filter bag may also be formed by a single layer of filter material such that the single layer is folded around one of its axes of symmetry and the remaining open peripheral edges of the resulting two partial layers are welded or glued (so-called tubular bag). Such manufacturing therefore requires several (e.g. three) weld or glue seams. Two of these seams form the filter bag edge, the third seam can also form a filter bag edge or may be located on the filter bag surface.

Each of the aforementioned single layers of filter material may comprise several nonwoven material layers, as it is usual nowadays for filter bags made of nonwoven material.

The weld or adhesive seams may also be formed as letterfold.

Flat bags may also comprise so-called side folds. These side folds can thereby completely folded apart. A flat bag with such side folds is shown, for example, in DE 20 2005 000 917 U1 (see there FIG. 1 with folded side folds and FIG. 3 with side folds folded apart). Alternatively, the side folds can be welded to portions of the peripheral edge. Such a flat bag is shown in DE 10 2008 006 769 A1 (cf. there in particular FIG. 1).

Filter bags with surface folds: EP 2 366 320 A1 and EP 2 366 321 A1 disclose filter bags with surface folds in the meaning of the present application.

Suction capacity: The suction capacity is the product of negative pressure [kPa] and air flow [l/s] and is denoted according to EN 60312 by $P_2$.

Degree of efficiency: The degree of efficiency of the motor/fan unit or a vacuum cleaner is calculated from the suction power $P_2$ and the input power according to EN 60312 section 5.8 (cf. in particular section 5.8.4, $4^{th}$ paragraph). For this, the motor/fan unit or the vacuum cleaner are connected to the measuring chamber (device B). For necessary intermediate parts, where appropriate for connection to the measuring chamber, the explanations in section 7.3.7.1 apply. The rated diameter do of the used apertures may be derived from the table in section 7.3.7.3. The degree of efficiency for an available aperture is calculated by using $$\eta[\%]=(P_2/P_1)*100.$$

Thereby, $P_1$ is the input power of the vacuum cleaner (with predetermined aperture) and $P_2$ is the air power (with predetermined aperture), thus, the product of air flow (cf. above) and vacuum (cf. below).

Tank-type vacuum cleaner: Construction of a vacuum cleaner according to which on a most of the times cylindrical dust collecting chamber, there is arranged a removable cover with a motor/fan unit. Tank-type vacuum cleaners ("Kesselstaubsauger") comprise filter bag receptacles (filter bag accommodation chambers) of 6 l to 25 l. Such a tank-type vacuum cleaner is shown in FIG. 6.

Negative pressure in the measuring chamber with predetermined aperture: The negative pressure in the measuring chamber with a predetermined aperture occurs according to EN 60312 section 5.8. For this, the motor/fan unit is directly connected to the measuring chamber (device B). For necessary intermediate parts, where appropriate for connection to the measuring chamber, the explanations in section 7.3.7.1 apply. The rated diameter do of the used apertures may be derived from the table in section 7.3.7.3.

Average cross-sectional area of the suction hose: For determining the average cross-sectional area of the suction hose, the cross-section of the suction hose is measured at 10 positions evenly distributed over the entire suction hose length and the average value of these measurements is determined. The first measurement thereby is conducted at the one end of the hose and the tenth measurement at the other end of the hose. The measurement of the cross-section is determined by means of limit gauges for internal dimensions, which correspond to the form of the cross-sectional area to be measured. Hoses, which change their cross-sectional area, the limit gauge is introduced into the suction hose in the direction of the enlarging cross-sectional area. Apart from uneven cross-sectional areas, thereby, also the cross-section areas of spirally or helically wound or otherwise structured suction hoses may be determined. Specifically, this method may also be used for conical suction hoses.

Bag surface of a filter bag: The bag surface of a filter bag denotes the surface, which is located between the lateral weld seams determining the outer form of the filter bag. Side folds and surface folds have to be taken into account. The area of the charging door including a weld seam encompassing this opening is subtracted from the surface. This exclusively refers to the theoretically usable surface. Differences of the flow conditions in the bag or due to an incomplete unfolding of the filter bag are not taken into account. For filter bags not being flat bags, of course all additional surfaces (e.g. block bottom bags with side and front surfaces) are consulted for determining the bag surface.

Volume filter receptacle: The volume may be determined from the 3D drawing data of the vacuum cleaner or by means of volumetric measurement with water or granulate.

Deflector device: Deflector devices for deflecting air in the meaning of the application are for example disclosed in WO 2007 059936 A1, WO 2007 059937 A1, WO 2007 059938 A1, and WO 2007 059939 A1

Bag cage: A bag cage refers to a device, with which it is secured that a gap is maintained between the filter bag and the wall of the filter bag receptacle. Thereby, attention must be paid to the fact that the contact surface between the filter bag and the bag cage is as small as possible. The bag cage may be made of arbitrary materials and may be removably or permanently installed. An example for a bag cage is shown in FIG. 5. A 3D data set of the bag cage described in FIG. 5 may be obtained from Eurofilters N.V., Lieven Gevaertlaan 21, 3900 Overpelt, Belgium. In case filter bags with surface folds are employed, a bag cage may be used, which is specifically adapted to these surface folds. From WO 2012 126612 (in particular FIGS. 3 and 4), it may be learnt how such a bag cage is configured.

Efficient vacuum cleaner: An efficient vacuum cleaner has an energy efficiency class B or better (according to VO 665/2013, ANNEX I) and simultaneously, achieves a cleaning performance class C or better (according to VO 665/2013, ANNEX I).

PRIOR ART

The requirements imposed on devices for vacuum cleaning in the past years are subject to a clear conversion.

As of 2017, VO 666/2013 requires to limit the nominal input power of vacuum cleaners to below 900 W. The regulation VO 665/2013 leads to the fact that in the long run, the annual energy consumption of a vacuum cleaner should be below 10 kWh. This results in an input power of a vacuum cleaner of below 300 W. The user of devices for vacuum cleaning, however will expect that the cleaning performance does not deteriorate, compared to devices for vacuum cleaners, as they are nowadays implemented with an essentially higher input power. This is also taken into account in VO 665/2013 by e.g. determining the requirement for an A evaluation (carpet cleaning performance class) for the dust pick-up for carpets to 91%.

Of particular importance are the requirements of the European Commission for tank-type vacuum cleaners, as well, which is defined by the fact that (cf. above) its filter bag receptacle has a volume of 6 to 25 l. This type of vacuum cleaner is employed for the industrial use and as household vacuum cleaner (definition, cf. VO 665/2013, section 2, lit 10). Despite the relatively big filter bag receptacles of tank-type vacuum cleaners and corresponding big filter bags, the efficiency of common tank-type vacuum cleaners is not satisfactory.

Thus, e.g. a Numatic Henry HVR200A implemented in the household as well as the industrial area, during determination of the air data according to EN 60312 section 5.8.4) at aperture 8 (40 mm) and an input power of $P_1$ of 1054 W (power level at the vacuum cleaner: $Hi_2$, in the following brief HI) only achieves a resulting suction air flow of 29.3 l/s. Even with this suction air flow, a very good dust pick-up of carpets (cleaning performance C or better) can rather be realized. The resulting air flow with an input power P1 of 472 W (suction capacity set level at the device: Lo, in the following brief LO) is insufficient for a satisfactory dust pick-up. Thus, with an input power of 472 W (at aperture 8), only an air flow of 21.3 l/s is achieved.

The situation in respect of the air flow even deteriorates with filling the filter bag when using the vacuum cleaner. FIG. 1*a* and/or FIG. 1*b* exemplarily shows the air flow (volume flow in l/s) of 465 W (LO) and/or 1026 W (HI) achieved by a Numatic Henry HVR200A at an average input power during the determination of the functional characteristics with a filled dust container depending on the filling with up to maximally 800 g DMT type 8 according to EN 60312.

In order to guarantee an efficient suctioning, air flows of at least 33 l/s are preferable.

The Numatic Henry HVR200A uses a motor/fan unit, the characteristics of which, thus, the air data of which are shown in FIG. 2*a* (LO) and FIG. 2*b* (HI).

The average electrical input power of the vacuum cleaner clearly has to be discriminated from the average electrical input power of the motor/fan unit, as the entire average electrical input power of the motor/fan unit basically is implemented with the air flow to be achieved, whereas the average electrical input power of the vacuum cleaner is also spent for compensating the flow losses resulting from the flow paths in the vacuum cleaning device (from the bottom nozzles to the air outlet of the device—without motor/fan unit).

The average electrical input power of the motor/fan unit regarding the Numatic Henry HVR200A is 968 W (HI) and/or 503 W (LO). Implementing this average input power, at aperture 8 (this aperture more or less corresponds to the conditions being available for vacuum cleaning hard floors), an air flow of approximately 49.0 l/s (HI) and approximately 36.7 l/s (LO) can be achieved, which when using this motor/fan unit in the Numatic Henry HVR200A, finally leads to the air flows already indicated above for aperture 8 (which then actually are also available for vacuum cleaning) of 29.3 l/s (HI) and 21.3 l/s (LO).

The suction hose of the Numatic Henry HVR200A has an average cross-sectional area of approximately 7.9 $cm^2$.

DESCRIPTION OF THE INVENTION

In view of the aforementioned drawbacks of the prior art, the objective technical problem underlying the invention is to provide a vacuum cleaning device with a tank-type vacuum cleaner and filter bags according to which the efficiency compared with the devices disclosed in the prior art is improved and according to which, when determining the air data pursuant to EN 60312 (section 5.8.4) at aperture 8 (40 mm), a suction air flow of more than 33 l/s is achieved, and wherein the average electrical input power of the vacuum cleaner is as low as possible so that the energy efficiency class B pursuant to VO 665/2013 or better is achieved, thus, an efficient vacuum cleaner in the meaning of the present invention is implemented.

This problem is solved by a device for vacuum cleaning according to claim 1. This comprises a tank-type vacuum cleaner with a suction hose connected with the housing of the vacuum cleaner and a filter bag, in particular a disposable filter bag made of nonwoven material with a bag surface (area) of between 2500 $cm^2$ and 5000 $cm^2$, wherein the tank-type vacuum cleaner has a motor/fan unit with an average electrical input power of 1000 W and 200 W. Thereby, the motor/fan unit is configured such that with an average electrical input power of between 1000 W and 800 W, a negative pressure in the measuring chamber at aperture 6 (23 mm) of greater than 4.0 kPa results, between 799 W and 600 W a negative pressure in the measuring chamber at aperture 6 of greater than 10.0 kPa results, and a negative pressure in the measuring chamber at aperture 8 of greater than 3.4 kPa results; between 599 W and 400 W, a negative pressure in the measuring chamber at aperture 6 of greater than 7.0 kPa results, and a negative pressure in the measuring chamber at aperture 8 of greater than 2.5 kPa results; and between 398 W and 200 W, a negative pressure in the measuring chamber at aperture 6 of greater than 4.0 kPa results, and a negative pressure in the measuring chamber at aperture 8 of greater than 1.4 kPa results.

This specific characteristic of the motor/fan unit differs from the characteristic of motor/fan units usually implemented in devices for vacuum cleaning.

The differences of the air data between the present invention and the prior art are illustrated in FIG. 2*a* and FIG. 2*b* showing the prior art, as well as in FIGS. 3*a* and 3*b* showing an embodiment according to the invention. At an identical input power, the motor/fan unit having the characteristic according to the invention with the apertures being essential for the cleaning effect (D6 and D8) provides a significantly higher air flow. D6 more or less corresponds to the situation during vacuum cleaning of carpets, D8 more or less corresponds to the situation of vacuum cleaning of hard floors.

Surprisingly, it has turned out that a motor/fan unit as specified above in combination with a suction hose and an average cross-sectional area of at least 9 $cm^2$ may be implemented particularly efficiency-enhancing for tank-type vacuum cleaners and together with the disposable filter bags made of nonwoven material are comparable in their cleaning performance with devices for vacuum cleaning as being nowadays only available with a significantly higher input power.

Therefore, the suction hose needs to have an average cross-sectional area of at least 9 $cm^2$, specifically at least 11 $cm^2$ or 13 $cm^2$.

Experiments have shown that the combination of the aforementioned motor/fan unit and the aforementioned suction hose with an average input power when determining the functional characteristics with a filled dust container of approximately 1020 W is sufficient for producing an air flow of more than 48 l/s (with an empty filter bag) and, thus, for achieving a suctioning result being more than satisfactory. Furthermore, it has turned out that even an input power of app. 460 W, which entirely meet also the future energy policy requirements, is sufficient for producing an air flow of more than 36 l/s (with an empty filter bag) and, thus, for the achieving a suctioning result being more than satisfactory.

The tank-type vacuum cleaner may in particular comprise a filter bag receptacle with a volume of 7 to 15 l. The volume may be determined by means of volumetric measurement with water or granulate according to EN 60312.

The suction hose may at least partially tapers conically and may have a greater cross-sectional area at one end near to the motor/fan unit than at an end distant to the motor/fan unit. In this case, the suction hose may have a minimum and maximum cross-sectional area and the minimum diameter of the suction hose may be reduced about at least 5%, specifically at least 20% in comparison to the maximum diameter. For example, the smallest diameter of the conical suction hose at the near end may have 35 mm and 47 mm at the distant end. Alternatively, the suction hose may continuously have a cylindrical form. Apart from the good handling, a conical form of the suction hose may also increase the power capacity of the tank-type vacuum cleaner.

Moreover, also other cross-sectional forms of the suction hose (conically tapered or with a consistent cross-section) are possible, as long as the claimed cross-sectional areas are observed.

The suction hose may have a length of 1 m to 3 m.

A suction pipe connected to the suction hose may have a diameter of more than 30 mm, preferably more than 33 mm and particularly preferred more than 36 mm.

The motor/fan unit at aperture 7 (30 mm) may have a degree of efficiency according to EN 60312 of at least 35%, preferably of at least 38% and particularly preferred of at least 40%. This embodiment of the invention results in a particularly efficient device for vacuum cleaning.

According to an embodiment of the above described invention including the above indicated embodiments of the invention, the tank-type vacuum cleaner comprises a bag cage, which is formed by an internal housing wall of the tank-type vacuum cleaner in order to receive the filter bag and to at least partially keep the same spaced-apart from the internal housing wall of the tank-type vacuum cleaner. Thereby, a decrease of the filter capacity due to attachment of the filter surface to an internal wall of the filter receptacle (filter bag accommodation chamber) may be avoided. An exemplary embodiment of a bag cage for the Numatic Henry HVR200A is shown in FIG. 5. Specifically, the bag cage for accommodating the filter bag, e.g. a filter bag with surface folds, may be formed.

In all above described embodiments, the filter bag may be provided in form of a flat bag. The flat bag shape is the most common form for nonwoven material bags, as bags with this form are very easy to produce. In contrast to the paper filter material used with filter bags made of paper, nonwoven material is only difficult to be permanently folded due to the high resilience so that the production of more complex bag forms, as for example block bottom bags or other bag forms with bottom actually is possible, however, is very complicated and expensive.

The filter bag may specifically have surface folds.

Moreover, the filter bag may be equipped with at least one deflector device. Accordingly, the above mentioned bag cage may be configured for accommodating filter bags with surface folds.

The different embodiments may be implemented as claimed individually or combined with one another.

EMBODIMENTS OF THE INVENTION

In the vacuum cleaning device according to the invention, a motor/fan unit having a specific characteristic in combination with a suction hose with a relatively large diameter is applied. This combination surprisingly leads to an efficient vacuum cleaner in the meaning of the invention, thus, to a vacuum cleaner falling into an energy efficiency class B or better (according to VO 665/2013, ANNEX I) and simultaneously, into a cleaning performance class C or better (according to VO 665/2013, ANNEX I).

The motor/fan unit is characterized by a high volume flow, a high air capacity (power) and a high efficiency degree at aperture 7 (30 mm) and 8 (40 mm).

Figure 3A:
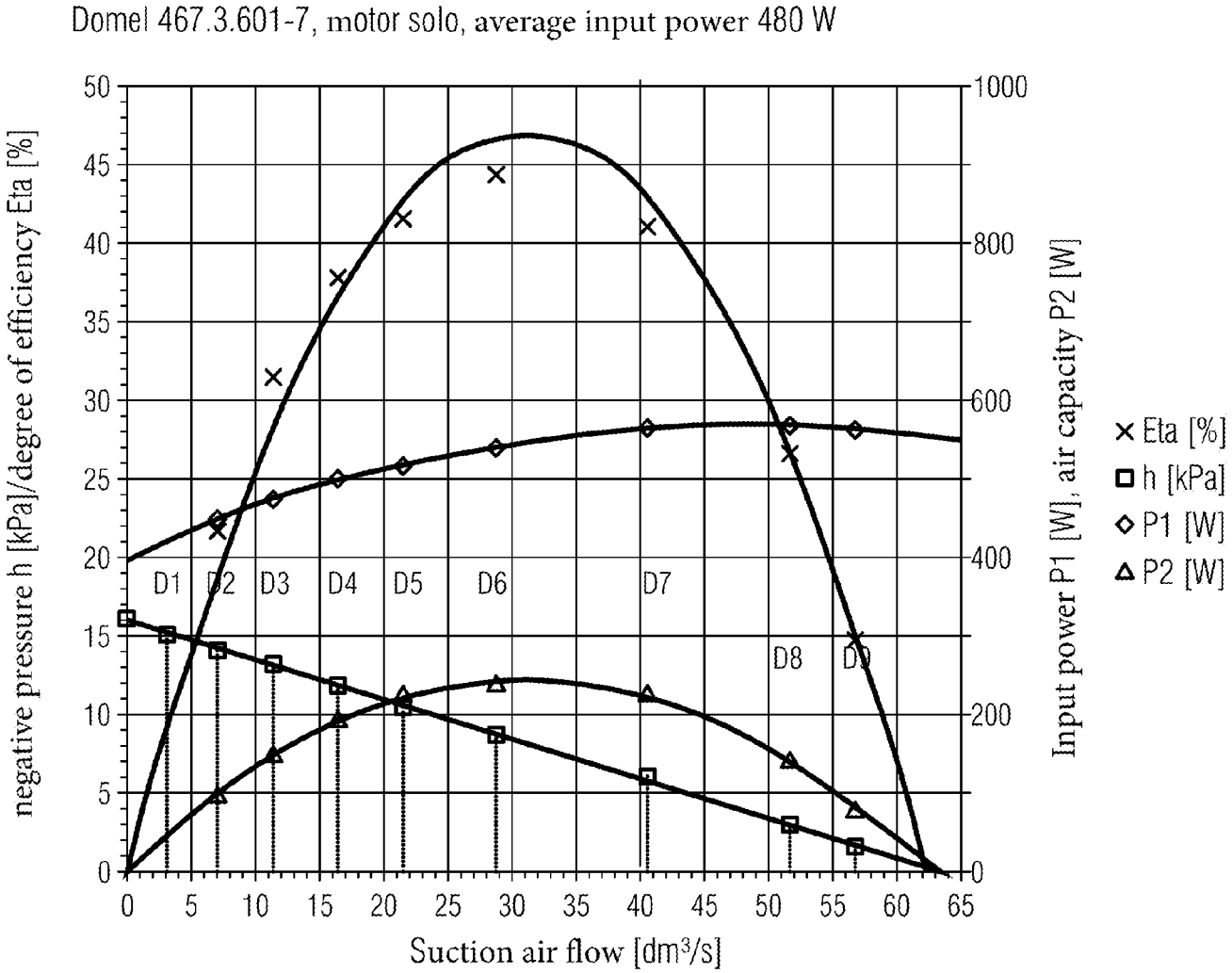
FIGS. 3*a* and 3*b* show air data for a motor/fan unit, which is explicitly suitable for being implemented in the present invention.
Figure 3B:
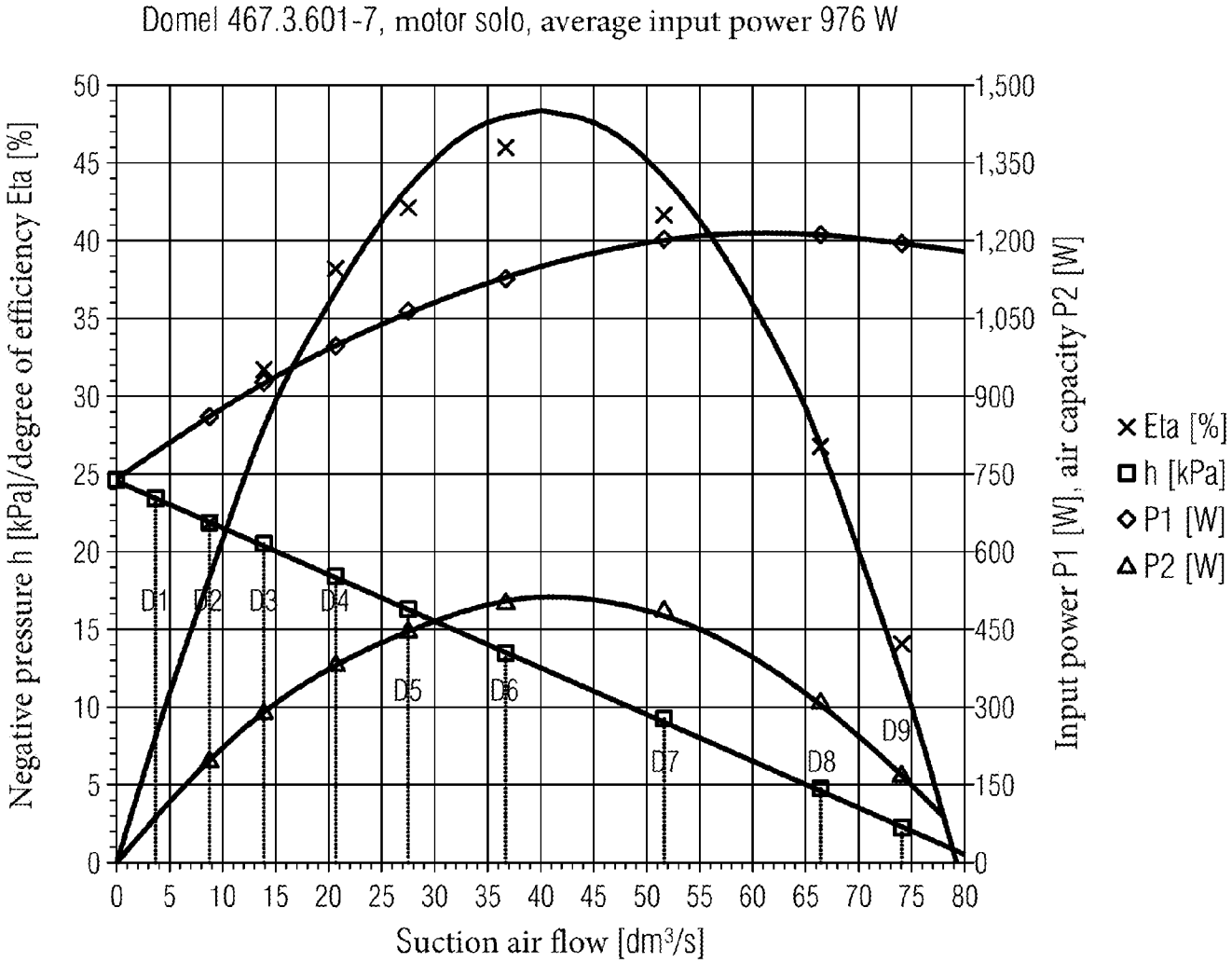

In FIGS. 3*a* and 3*b*, air data are shown for an exemplary embodiment of the motor/fan unit as used according to the invention, here a motor/fan unit of the company Domel with the type designation 467.3.601-7. On the x-axis, the suction air flow in units of $dm^3/s$ and/or l/s is respectively plotted. The y-axis respectively shows values of the negative pressure (in kPa), the degree of efficiency (in %), the input power (in W), and the air capacity (in W). In FIG. 3*a*, results for an average electrical input power of app. 480 W, in FIG. 3*b* of app. 976 W are shown.

Figure 2A:
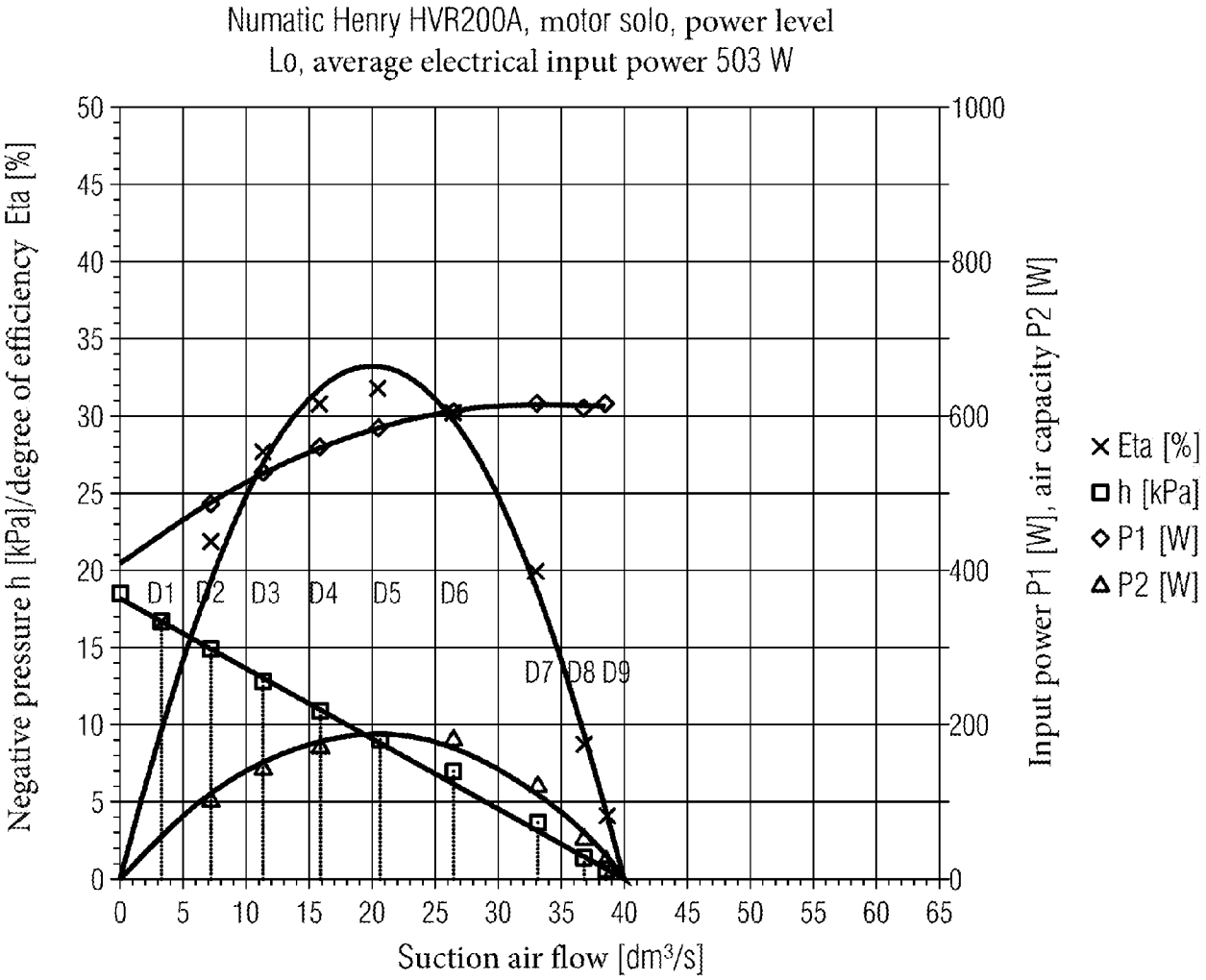
FIGS. 2*a* and 2*b* show air data for a motor/fan unit, which is implemented in vacuum cleaning devices according to the prior art.
Figure 2B:
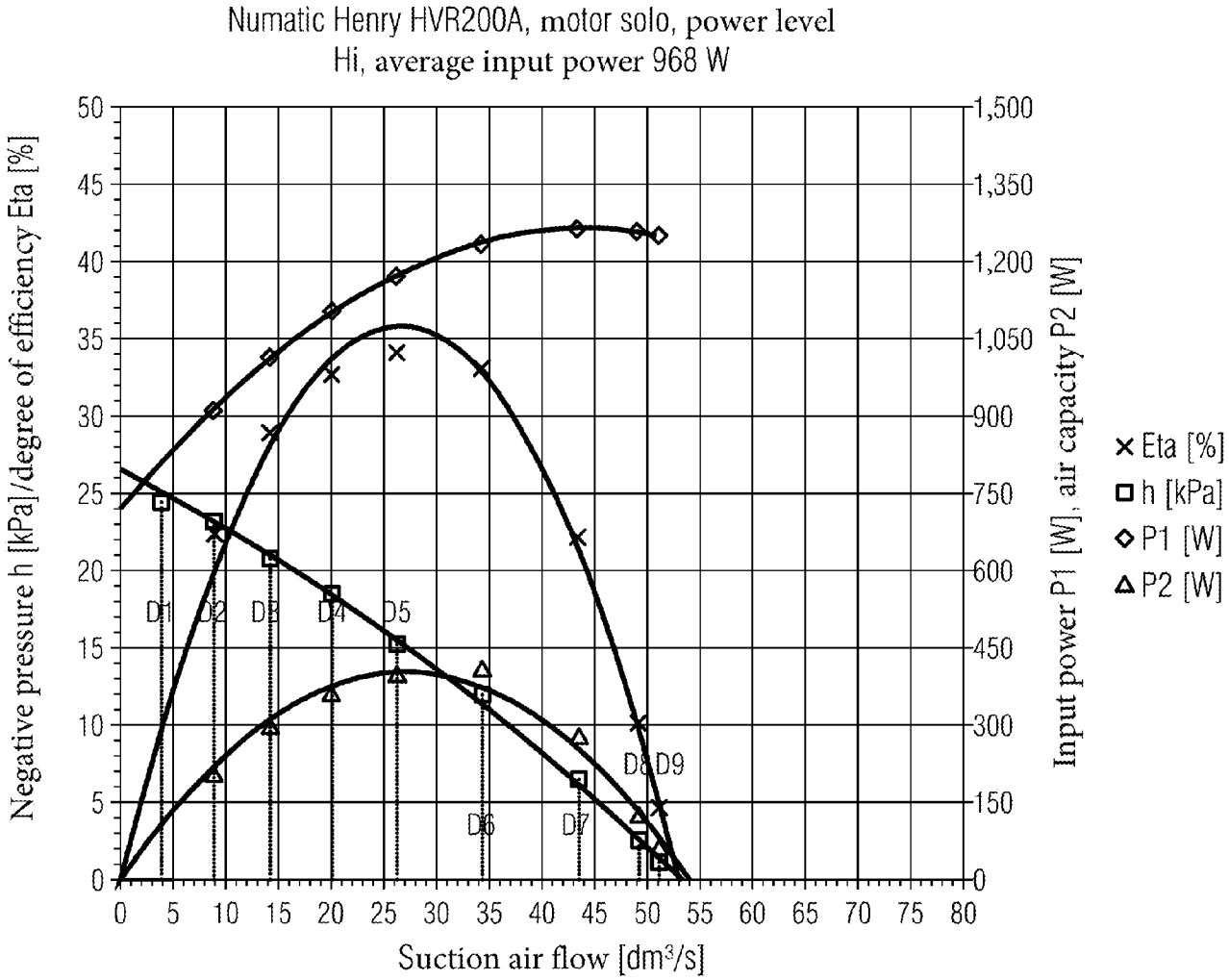

As already mentioned earlier, for comparison, FIGS. 2*a* and 2*b* show air data for a motor/fan unit of the prior art. In FIG. 2*a*, the air data for an average electrical input power of app. 503 W and in FIG. 2*b* of app. 1968 W are shown.

In table 1, the relevant measured values for an exemplary embodiment of the motor/fan unit according to the invention and a motor/fan unit according to the prior art are compared with one another. With a similar average electrical input power, the air data at aperture 7 and aperture 8 as well as the air capacity at aperture 7 and aperture 8, and the degree of efficiency at aperture 7 and aperture 8 for the exemplary embodiment are significantly higher than for the prior art. For example, the air capacity at aperture 8 and an average electrical input power of approximately 480 W regarding the exemplary embodiment is approximately three times higher than for the prior art.

With a comparable input power, the degree of efficiency and the air flow of the embodiment according to the invention are superior to the motor/fan unit of the prior art. Specifically, with a relatively low average electrical input power with the relevant apertures corresponding to the real situation on hard and carpeted floors, a very good air flow may be achieved, with which a good cleaning performance class may be realized.

Figure 1A:
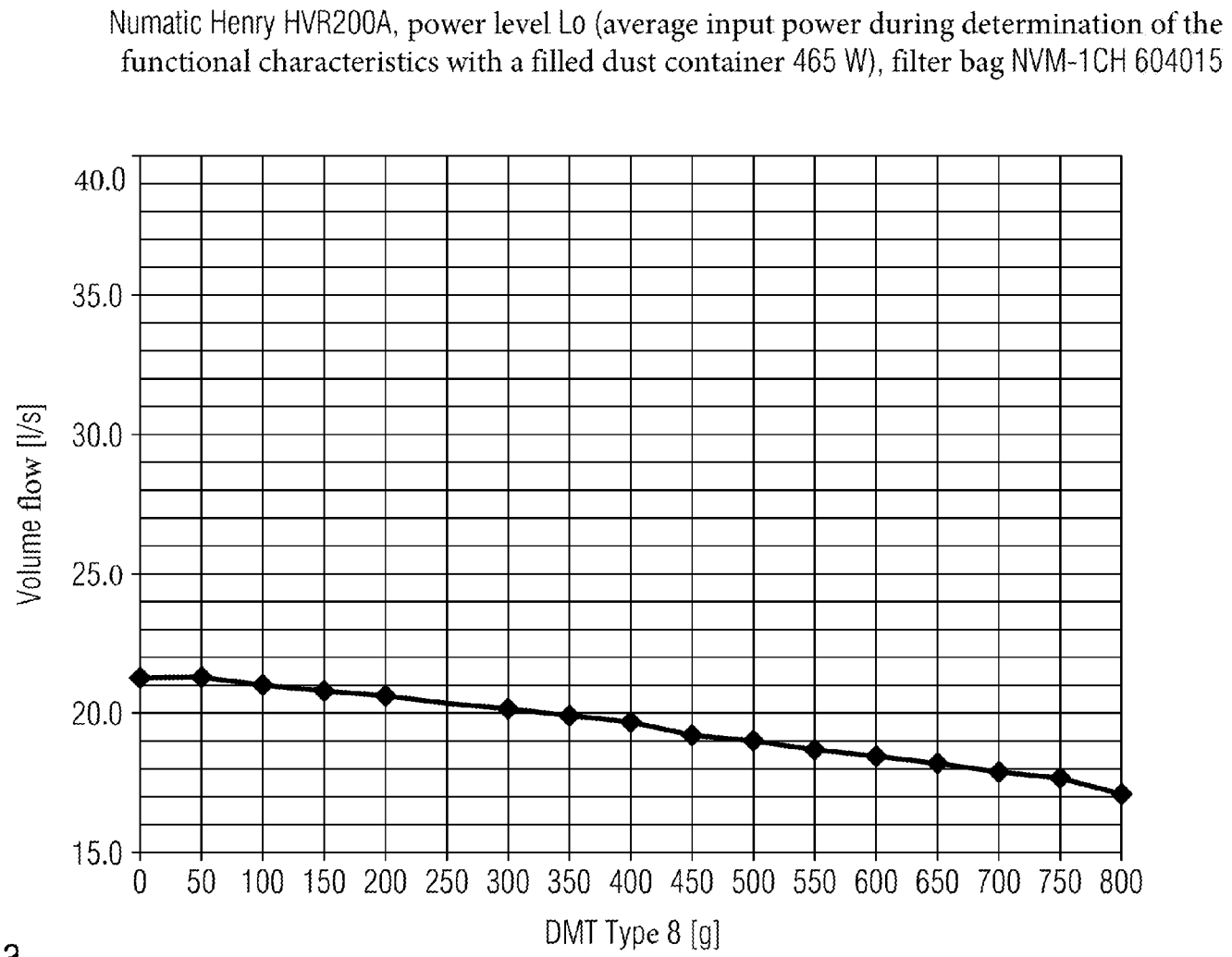
FIGS. 1*a* and 1*b* show the dependency of the achieved air flow on the filling of the filter bag according to the prior art.
Figure 1B:
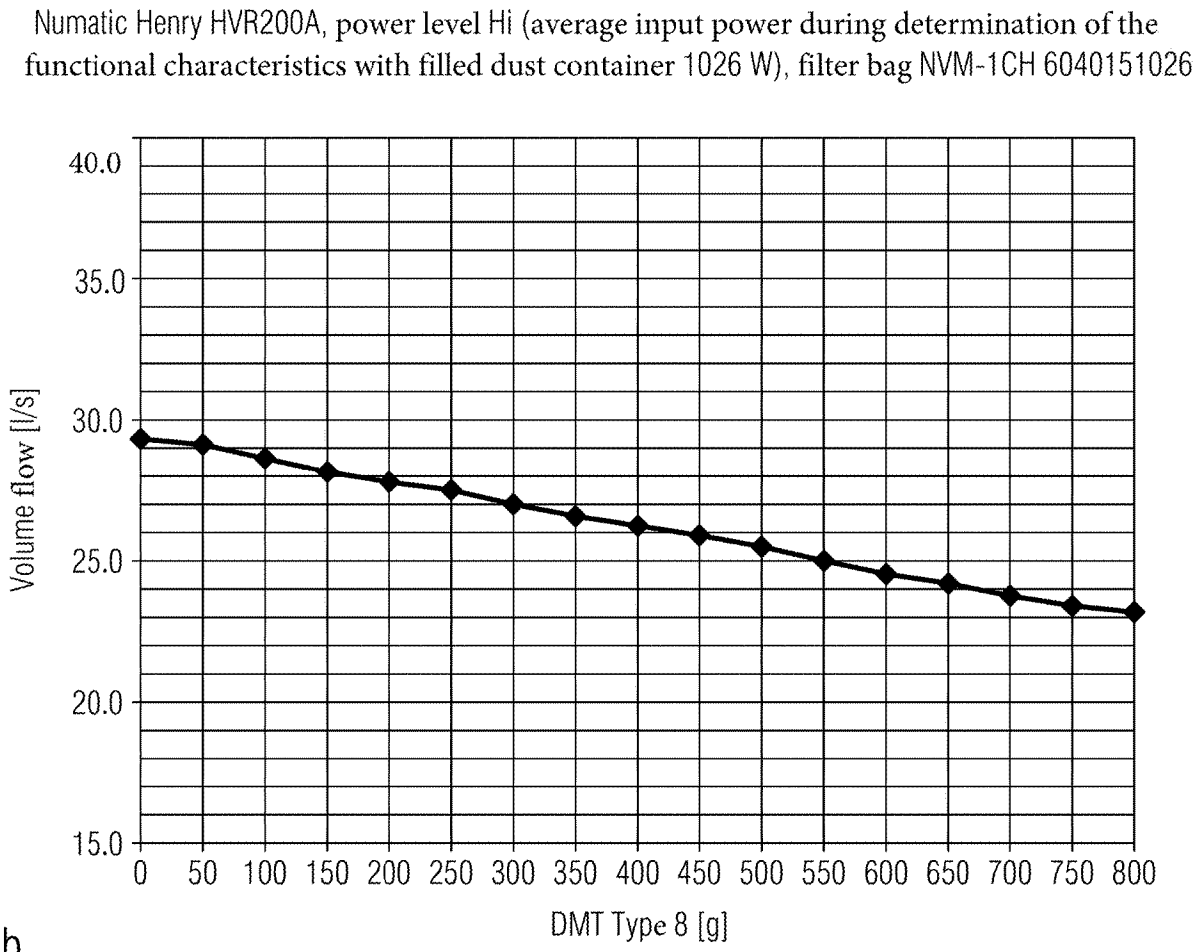
Figure 4A:
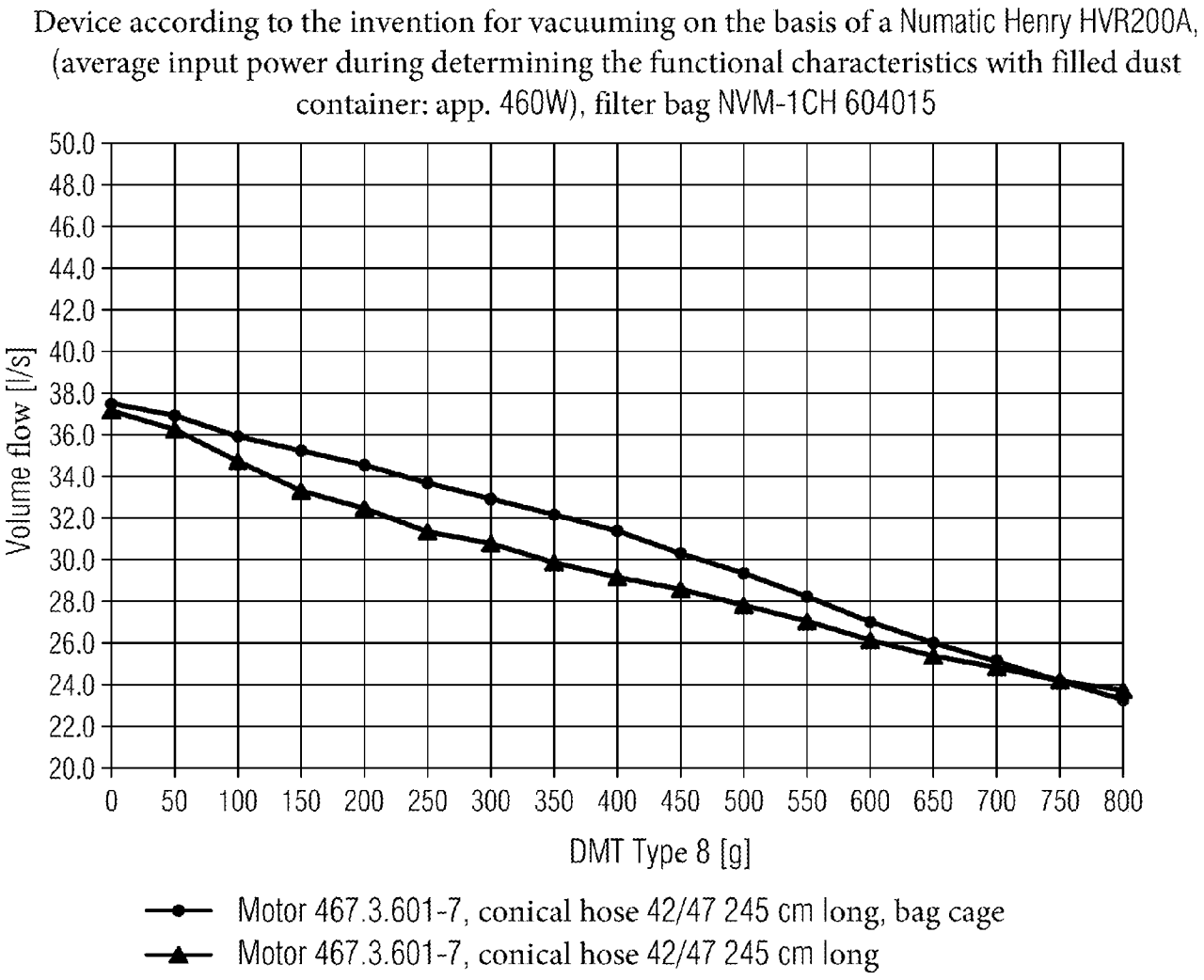
FIGS. 4*a* and 4*b*: shows the dependency of the achieved air flow on the filling of the filter bag for different embodiments of a device according to the invention.
Figure 4B:
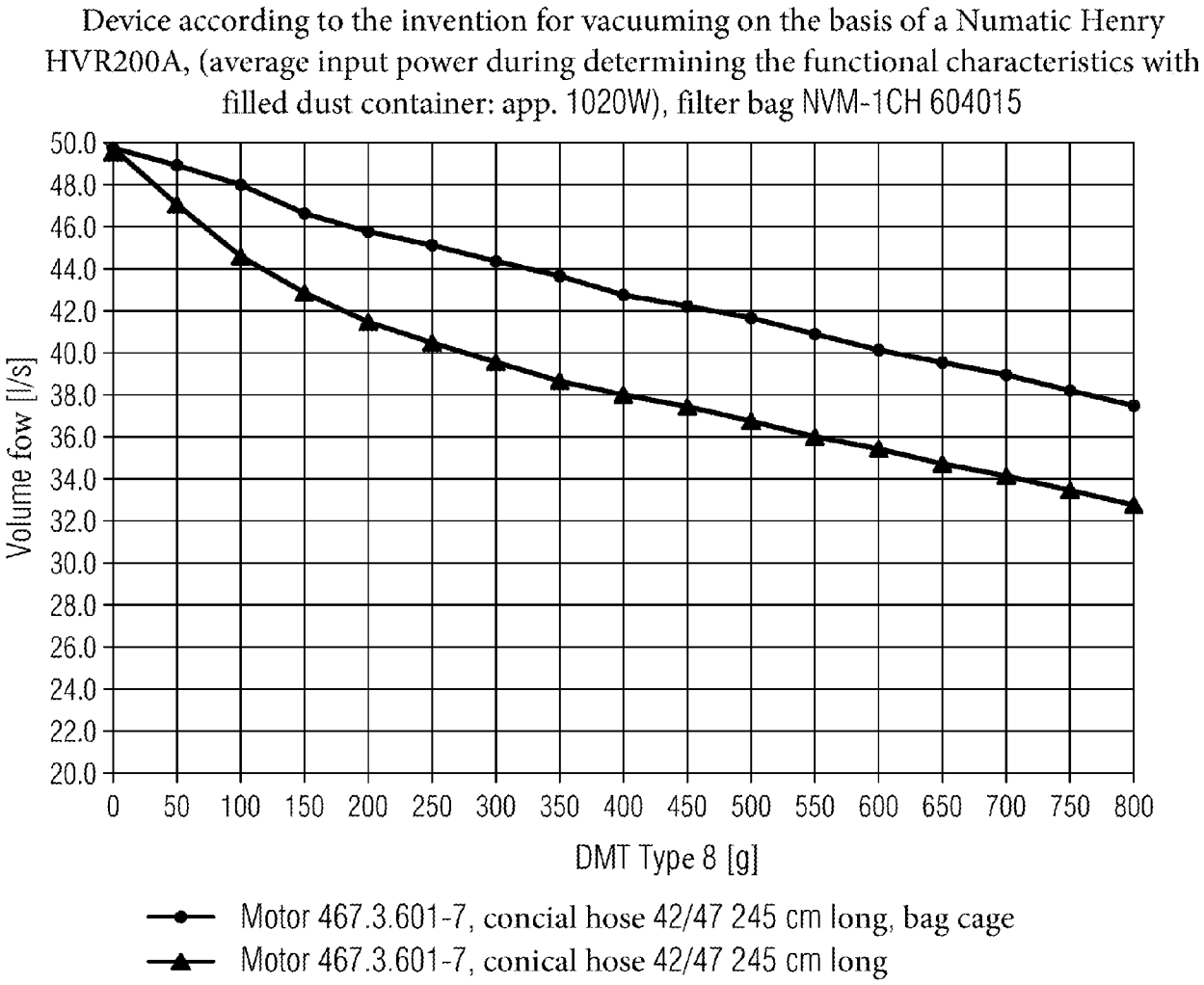
Figure 5:
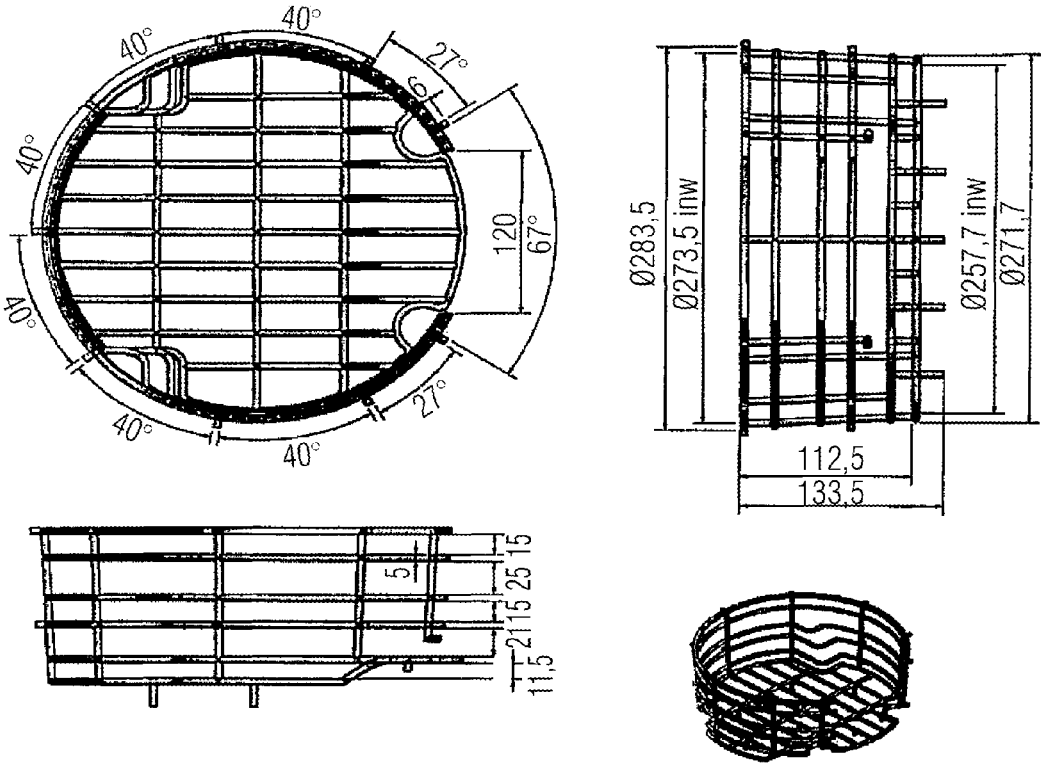
FIG. 5 shows a bag cage, which is particularly suitable to be implemented in the present invention.
Figure 6:
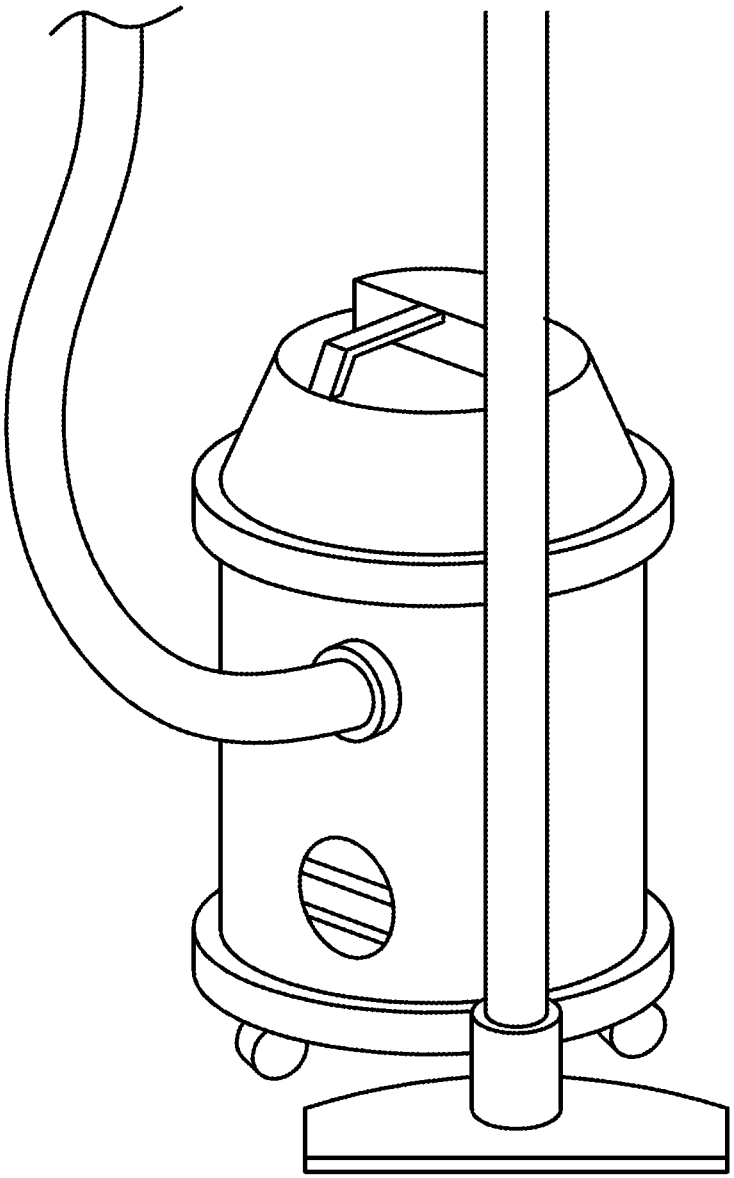
FIG. 6 shows a schematic view of a tank-type vacuum cleaner.

In FIGS. 4*a* and 4*b*, for vacuum cleaning devices according to the invention, the dependency of the achieved air flow on the filling quantity of the filter bag is shown. The results shown are to be compared with those for vacuum cleaning devices of the prior art, as shown in FIGS. 1*a* and 1*b*.

FIG. 4 shows results for an average input power of app. 460 W and/or app. 1020 W by using a flat bag and of a conical hose with a minimum diameter of 47 mm by using or not using a bag cage. For the average cross-sectional area of the embodiment according to the invention, thus, a value of 15.6 $cm^2$ occurs. The used filter bag has a surface of app. 3080 $cm^2$. The used material was Material SMS92, which is to be obtained from Eurofilters N.V., Lieven Gevaertlaan 21, 3900 Overpelt, Belgium. Moreover, the embodiment according to the invention corresponds to the prior art as already explained earlier. Even with an average input power of only app. 460 W with an empty filter bag, a volume flow of nearly 38 l/s is achieved; for a filling with 400 g DMT type 8 and by using a bag cage, still nearly 32 l/s volume flow is achieved, and even after charging 800 g DMT 8, still a volume flow results of nearly 24 l/s. With an average input power of only app. 1020 W, even without using a bag cage with empty filter bag, nearly 50 l/s is achieved and with a high filling of 800 g DMT type 8 still around 32 l/s volume flow is achieved.

Thus, the achievable volume flows are considerably higher than in the prior art, according to which with an average input power of app. 465 W, only a volume flow of 21 l/s with an empty filter bag and with app. 1026 W, a volume flow with an empty filter bag of just under 30 l/s can be achieved.

In the following table, the air data for the tank-type vacuum cleaner Numatic HVR200A (HI and LO) according to the prior art as well as according to the above described embodiment of the tank-type vacuum cleaner according to the invention are summarized:

| | Voltage [V] | Average electrical power input [W] | Air flow aperture 7 [l/s] | Air flow aperture 8 [l/s] | Air capacity at aperture 7 [W] | Air capacity at aperture 8 [W] | Degree of efficiency aperture 7 [%] | Degree of efficiency aperture 8 [%] |
|---|---|---|---|---|---|---|---|---|
| Numatic HVR200A Power level Hi | 230 | 968 | 43.2 | 49.0 | 280.6 | 127.2 | 22.1 | 10.1 |
| Domel 467.3.601-7 | 220 | 976 | 52.0 | 66.3 | 496.3 | 319.0 | 41.5 | 26.3 |
| Numatic HVR200A Power level Lo | 230 | 503 | 33.0 | 36.7 | 122.7 | 53.1 | 19.9 | 8.7 |
| Domel 467.3.601-7 | 130 | 480 | 40.6 | 51.8 | 232.0 | 150.2 | 40.9 | 26.3 |

The invention claimed is:

1. A vacuum cleaning device comprising:

a tank-type vacuum cleaner having a suction hose connected to a housing of the tank-type vacuum cleaner, and comprising:

a disposable filter bag, wherein the tank-type vacuum cleaner comprises a motor/fan unit, which is configured to operate at an average electrical input power between 1000 W and 200 W measured in accordance with Standard DIN EN 60312-1, section 5.8;

wherein when the vacuum cleaning device is tested in accordance with Standard DIN EN 60312-1, section 5.8, operating at the average electrical input power between 1000 W and 800 W with aperture 6 (23 mm) the vacuum cleaning device generates a negative pressure in the measurement chamber greater than 12.5 kPa;

wherein when the vacuum cleaning device is tested in accordance with Standard DIN EN 60312-1, section 5.8, operating at the average electrical input power between 1000 W and 800 W with aperture 8 (40 mm) the vacuum cleaning device generates a negative pressure in the measurement chamber greater than 4.0 kPa;

wherein when the vacuum cleaning device is tested in accordance with Standard DIN EN 60312-1, section 5.8, operating at the average electrical input power between 799 W and 600 W with aperture 6 (23 mm) the vacuum cleaning device generates a negative pressure in the measurement chamber greater than 10.0 kPa;

wherein when the vacuum cleaning device is tested in accordance with Standard DIN EN 60312-1, section 5.8, operating at the average electrical input power between 799 W and 600 W with aperture 8 (40 mm) the vacuum cleaning device generates a negative pressure in the measurement chamber greater than 3.4 kPa;

wherein when the vacuum cleaning device is tested in accordance with Standard DIN EN 60312-1, section 5.8, operating at the average electrical input power between 599 W and 400 W with aperture 6 (23 mm) the vacuum cleaning device generates a negative pressure in the measurement chamber greater than 7.0 kPa;

wherein when the vacuum cleaning device is tested in accordance with Standard DIN EN 60312-1, section 5.8, operating at the average electrical input power between 599 W and 400 W with aperture 8 (40 mm) the vacuum cleaning device generates a negative pressure in the measurement chamber greater than 2.5 kPa;

wherein when the vacuum cleaning device is tested in accordance with Standard DIN EN 60312-1, section 5.8, operating at the average electrical input power between 399 W and 200 W with aperture 6 (23 mm) the vacuum cleaning device generates a negative pressure in the measurement chamber greater than 4.0 kPa;

wherein when the vacuum cleaning device is tested in accordance with Standard DIN EN 60312-1, section 5.8, operating at the average electrical input power between 399 W and 200 W with aperture 8 (40 mm) the vacuum cleaning device generates a negative pressure in the measurement chamber greater than 1.4 kPa;

wherein the suction hose has an average cross-sectional area of at least 9.5 $cm^2$, and wherein the filter bag has a bag surface of between 2500 $cm^2$ and 5000 $cm^2$ and is made of nonwoven material.

2. The device according to claim 1, wherein the tank-type vacuum cleaner comprises a filter bag receptacle with a volume of 7 l to 15 l.

3. The device according to claim 2, wherein the suction hose conically tapers at least partially and has at an end nearest to the motor/fan unit a greater cross-sectional area than at an end distant to the motor/fan unit.

4. The device according to claim 3, wherein the suction hose has a minimum and a maximum cross-sectional surface and wherein a minimum diameter of the suction hose is reduced by at least 5% compared to the maximum cross-sectional area.

5. The device according to claim 1, wherein the suction hose has a length of 1 m to 3 m.

6. The device according to claim 1, wherein a suction pipe connected to the suction hose has a diameter of more than 30 mm.

7. The device according to claim 1, wherein when the vacuum cleaning device with aperture 7 (30 mm) is tested in accordance with DIN EN 60312-1 section 5.8.4, the vacuum cleaning device has a degree of efficiency of at least 35%.

8. The device according to claim 1 wherein the filter bag comprises a flat bag.

9. The device according to claim 1, wherein the filter bag has surface folds.

10. The device according to claim 1, wherein the filter bag is equipped with at least one deflector device.

11. The device according to claim 1, wherein the tank-type vacuum cleaner comprises a bag cage, which is configured in order to accommodate the filter bag and to at least partially space the filter bag from an internal housing wall of the tank-type vacuum cleaner.

12. The device according to claim 11, wherein the bag cage is configured to accommodate the filter bag with surface folds.

13. The device according to claim 1, wherein the average cross-sectional area of the suction hose is at least 11 $cm^2$.

14. The device according to claim 4, wherein the minimum diameter of the suction hose is reduced by at least 20% compared to the maximum cross-sectional area.

15. The device according to claim 6, wherein the diameter of the suction pipe is more than 33 mm.

16. The device according to claim 6, wherein the diameter of the suction pipe is more than 36 mm.

17. The device according to claim 1, wherein when the vacuum cleaning device with aperture 7 (30 mm) is tested in accordance with DIN EN 60312-1 section 5.8.4, the vacuum cleaning device has a degree of efficiency at least 38%.

18. The device according to claim 1, wherein when the vacuum cleaning device with aperture 7 (30 mm) is tested in accordance with DIN EN 60312-1 section 5.8.4, the vacuum cleaning device has a degree of efficiency more than 40%.

* * * * *